US011331535B2

(12) United States Patent
Gezalyan

(10) Patent No.: US 11,331,535 B2
(45) Date of Patent: May 17, 2022

(54) EXERCISE MACHINE

(71) Applicant: Sarkis Gezalyan, Sherman Oaks, CA (US)

(72) Inventor: Sarkis Gezalyan, Sherman Oaks, CA (US)

( * ) Notice: Subject to any disclaimer, the term of this patent is extended or adjusted under 35 U.S.C. 154(b) by 0 days.

(21) Appl. No.: 17/493,178

(22) Filed: Oct. 4, 2021

(65) Prior Publication Data

US 2022/0111250 A1 Apr. 14, 2022

Related U.S. Application Data

(60) Provisional application No. 63/204,604, filed on Oct. 14, 2020.

(51) Int. Cl.

| | |
|---|---|
| ***A63B 23/035*** | (2006.01) |
| ***A63B 23/02*** | (2006.01) |
| ***A63B 21/00*** | (2006.01) |
| ***A63B 22/20*** | (2006.01) |

(52) U.S. Cl.

CPC .... *A63B 23/03566* (2013.01); *A63B 21/4009* (2015.10); *A63B 21/4039* (2015.10); *A63B 21/4045* (2015.10); *A63B 22/20* (2013.01); *A63B 22/201* (2013.01); *A63B 22/203* (2013.01); *A63B 23/02* (2013.01); *A63B 23/0205* (2013.01); *A63B 2022/206* (2013.01)

(58) Field of Classification Search

CPC ..... A63B 19/00–04; A63B 21/4045; A63B 21/4001; A63B 21/4009; A63B 21/4039; A63B 22/0002–0005; A63B 22/0025; A63B 22/20–203; A63B 2022/0028; A63B 2022/206; A63B 23/02–0205; A63B 23/03508–03516; A63B 23/03533–03541; A63B 23/03566; A61H 7/001–005; A61H 7/007; A61H 2007/009; A61H 11/00–02; A61H 15/00–0092

See application file for complete search history.

(56) References Cited

U.S. PATENT DOCUMENTS 3,814,085 A * 6/1974 Kupchinski ..... A61H 15/0092 601/122
3,868,786 A * 3/1975 Lippe ..... A01K 27/001 446/28
5,997,449 A * 12/1999 Lee ..... A61H 15/00 446/236

(Continued)

*Primary Examiner* — Garrett K Atkinson
*Assistant Examiner* — Kathleen M Fisk
(74) *Attorney, Agent, or Firm* — Barry Choobin; Patent 360

(57) ABSTRACT

A machine for exercising arms and shoulders and reducing abdominal fat. The machine includes a frame of curve shape. Straps extend from the ends of the frame for tightening the machine over the abdomen. The frame includes an upper rail, a middle rail, and a lower rail, the upper rail and middle rail form an upper track and the middle rail and lower rail form a lower track. An upper set of rollers are mounted in the upper track and an upper handle is coupled to the upper set of rollers. A lower set of rollers are mounted to the lower track and a lower handle is coupled to the lower set of rollers. The upper handle and the lower handle are grasped to pull and push the upper set of rollers and the lower set of rollers to roll back-and-forth in the upper track and the lower track respectively.

17 Claims, 11 Drawing Sheets

(56) References Cited

U.S. PATENT DOCUMENTS

| | | | | |
|---|---|---|---|---|
| 6,217,482 | B1 * | 4/2001 | Yoo | A63B 19/00 482/10 |
| 7,232,357 | B2 * | 6/2007 | Chen | A63B 19/00 446/236 |
| 9,687,688 | B2 * | 6/2017 | Hsiao | A63B 19/00 |
| 9,873,015 | B2 * | 1/2018 | Jolly | A63B 23/025 |
| 10,143,883 | B2 * | 12/2018 | Jolly | A63B 21/4007 |
| 10,639,516 | B2 * | 5/2020 | Thomas | A63B 21/4009 |
| 10,843,035 | B2 * | 11/2020 | Jolly | A63B 21/4007 |
| 2002/0165073 | A1 * | 11/2002 | Tsai | A61H 15/0092 482/148 |
| 2013/0289454 | A1 * | 10/2013 | Wang | A61H 15/00 601/132 |
| 2014/0342882 | A1 * | 11/2014 | Huang | A63B 21/222 482/110 |
| 2015/0367171 | A1 * | 12/2015 | Truong | A61H 11/02 482/4 |
| 2021/0252323 | A1 * | 8/2021 | Lu | A63B 19/02 |

* cited by examiner

EXERCISE MACHINE

CROSS-REFERENCE TO RELATED APPLICATIONS

This application claims priority of a U.S. provisional patent application Ser. No. 63/204,604, filed on Oct. 14, 2020, which is incorporated herein by reference in its entirety.

FIELD OF INVENTION

The present invention relates to an exercise machine, and more particularly, the present invention relates to an exercise machine for reducing fat around the abdominal area and waistline while exercising the arms and shoulders.

BACKGROUND

Abdominal obesity, also known as central obesity, visceral, and truncal obesity, refers to a condition when excessive fat is built up around the abdomen. This excessive fat is also known as abdominal fat mass or visceral fat. Abdominal obesity is not only a cosmetic problem but also related to a number of diseases, such as metabolic and vascular diseases. A number of lifestyle diseases, such as diabetes, hypertension, heart diseases, and like have been linked to abdominal obesity. Unlike fat build-up in other body parts, abdominal fat is hard to burn.

Besides the diet and abdominal exercise, abdominal belts are available that can be worn around the abdomen. The abdominal belts provide heat and vibrations to reduce abdominal fat. However, such abdominal belts are of limited use in reducing abdominal fat.

A desire is there for an exercise machine for reducing the abdominal fat and also allows exercising other body parts.

The phrase "abdominal obesity" hereinafter refers to build up of excess fat around the abdomen and sides of the waist.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to an exercise machine for reducing abdominal obesity.

It is another object of the present invention that the exercise machine can also provide for exercising the arms and shoulders.

It is still another object of the present invention that the exercise machine can be used while watching a screen.

It is yet another object of the present invention that the exercise machine is economical to manufacture.

It is a further object of the present invention that the exercise machine is portable and compact for storage and transport.

It is still a further object of the present invention that the exercise machine can additionally provide heat.

It is an additional object of the present invention that the exercise machine can satisfactorily reduce abdominal fat.

It is still an additional object of the present invention that the exercise machine can incorporate liquid or semi-solid material for rubbing between the rollers and skin.

In one aspect, disclosed is an exercise machine for reducing abdominal fat as well as exercising the arms and shoulders. The exercise machine includes a frame that can be of curved shape to conform to the curves of the abdomen and waist. Straps extend from the ends of the frame for tightening the exercise machine over the abdomen. The frame includes an upper rail, a middle rail, and a lower rail, wherein the three rails run horizontally and parallel to each other along the length of the frame. The upper rail and the middle rail form an upper track and the middle rail and the lower rail forms a lower track. An upper set of rollers are slidably mounted in the upper track and an upper handle is coupled to the upper set of rollers. Similarly, a lower set of rollers can be mounted to the lower track and a lower handle is coupled to the lower set of rollers. The upper handle and the lower handle can be grasped to pull and push the upper set of rollers and the lower set of rollers to slide along the upper track and the lower track respectively in a back-and-forth manner.

In one aspect, the disclosed exercise machine can be worn around the abdomen with the frame juxtapose to the abdomen. The upper handle and the lower handle can be grasped and the upper set of the rollers and the lower set of rollers can be forced to move back-and-forth in their respective tracks. The rollers can slide against the abdomen with pressure disintegrating the abdominal fat. The amount of pressure created by the rollers on the abdomen can depend upon the tightness of the exercise machine around the abdomen.

In one aspect, the rollers can be made of material that can quickly heat up, for example by absorbing sunlight, wherein the heated rollers rubbing against the abdomen can provide enhanced fat disintegration action. Alternatively, the rollers can be manually heated using a heating electrode powered by a battery.

In one aspect, the rollers can be cooled and the cooled rollers can be rubbed against the abdomen for hastening the disintegration of the abdominal fat.

In one aspect, the disclosed exercise machine can have an inner cover made of rubber, silicone, or like material, wherein the rollers can rub against the inner cover, and the pressure can be transferred to the skin.

These and other objects and advantages of the embodiments herein and the summary will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
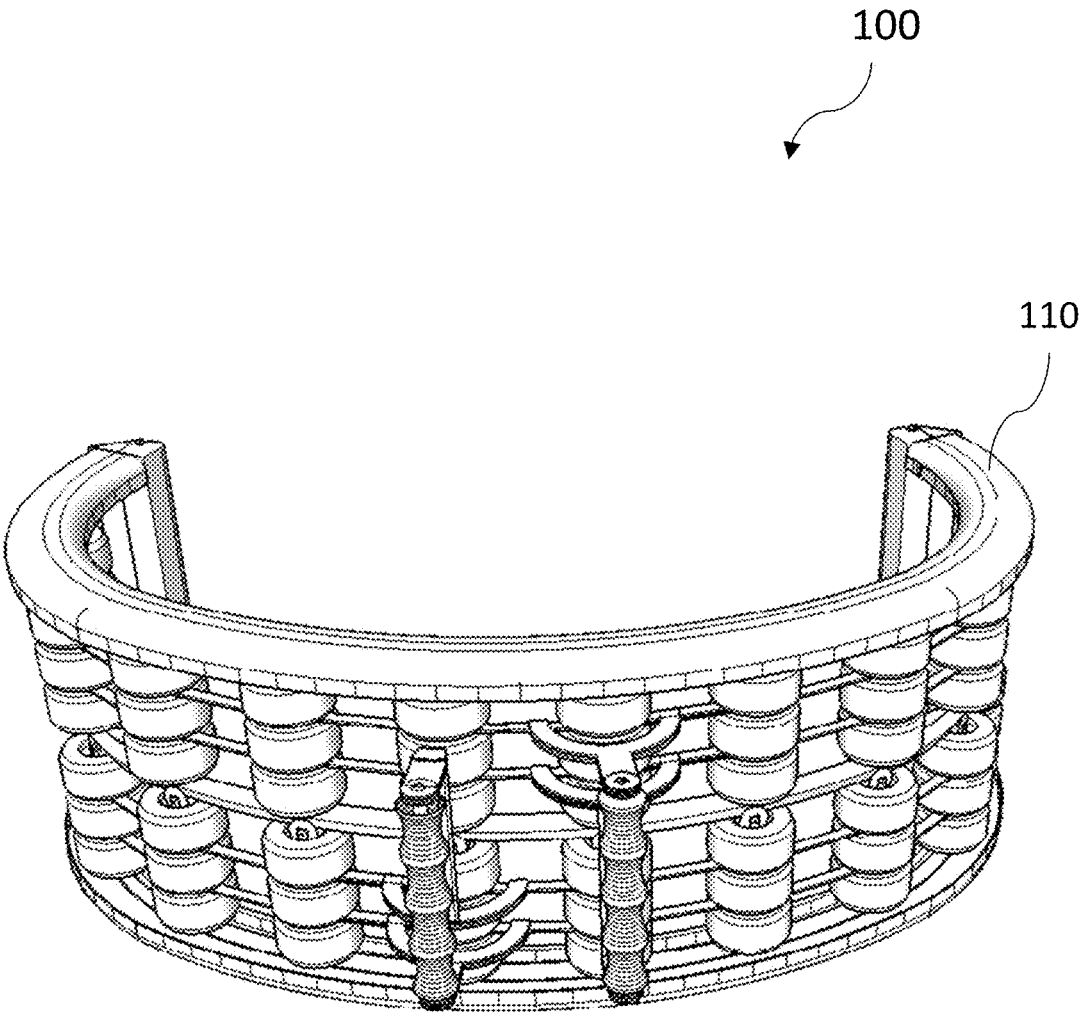
FIG. 1 is a perspective view of the disclosed exercise machine, according to an exemplary embodiment of the present invention.
Figure 2:
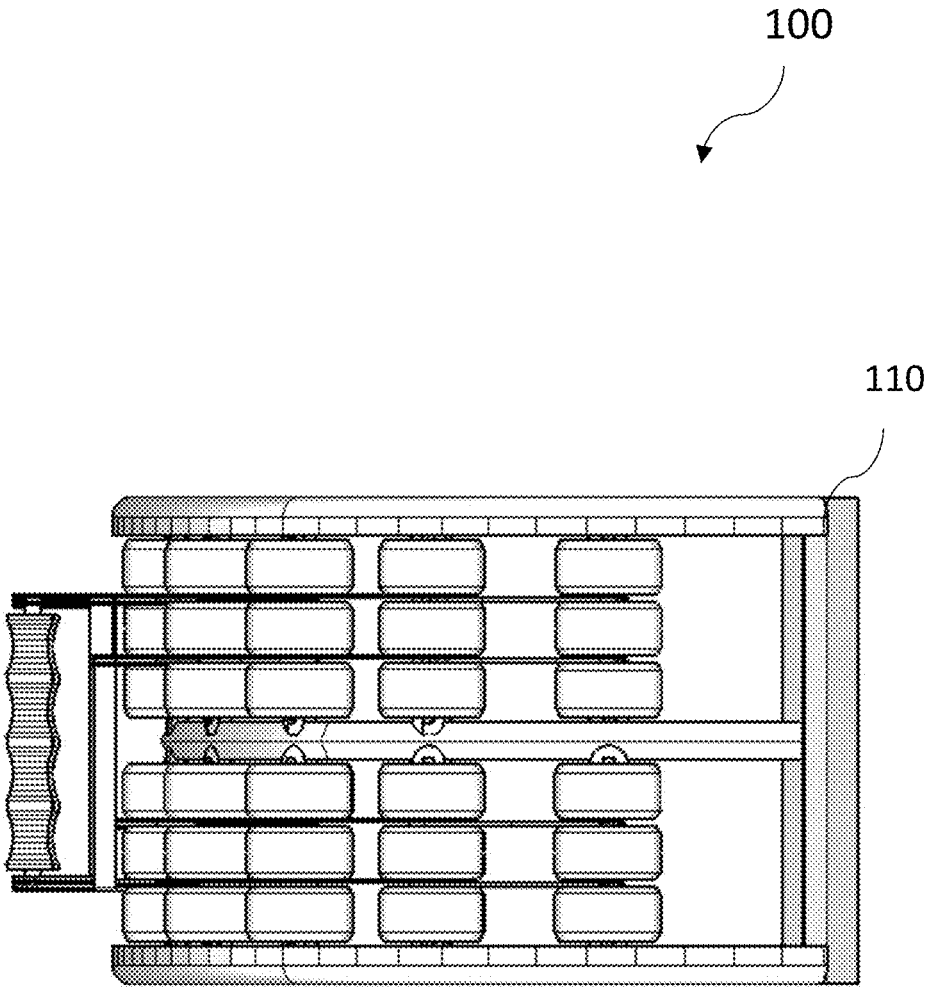
FIG. 2 is a side view of the exercise machine, according to an exemplary embodiment of the present invention.
Figure 3:
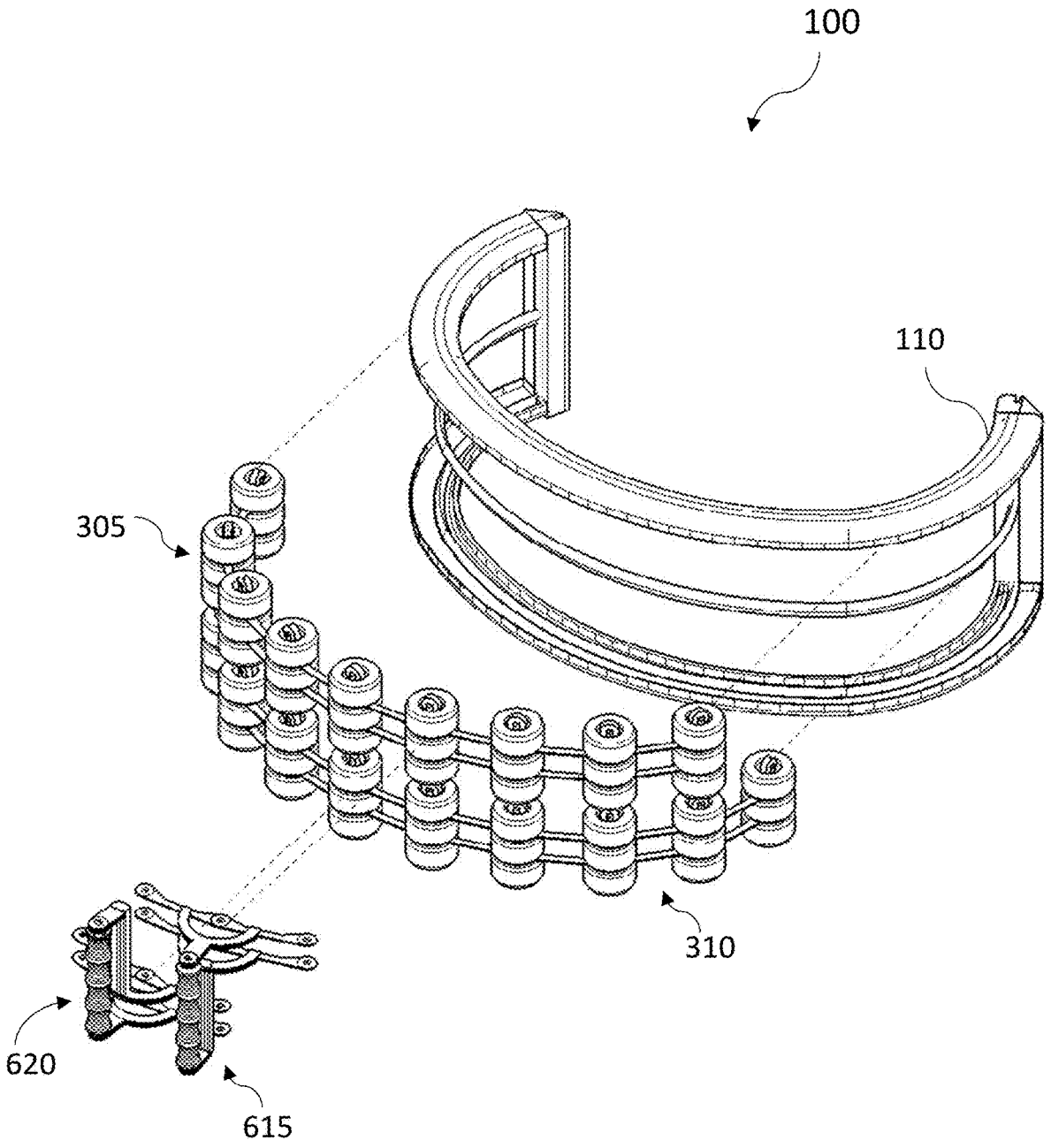
FIG. 3 is an exploded view of the exercise machine showing the frame, an upper set of rollers, a lower set of rollers, an upper handle, and a lower handle, according to an exemplary embodiment of the present invention.
Figure 4:
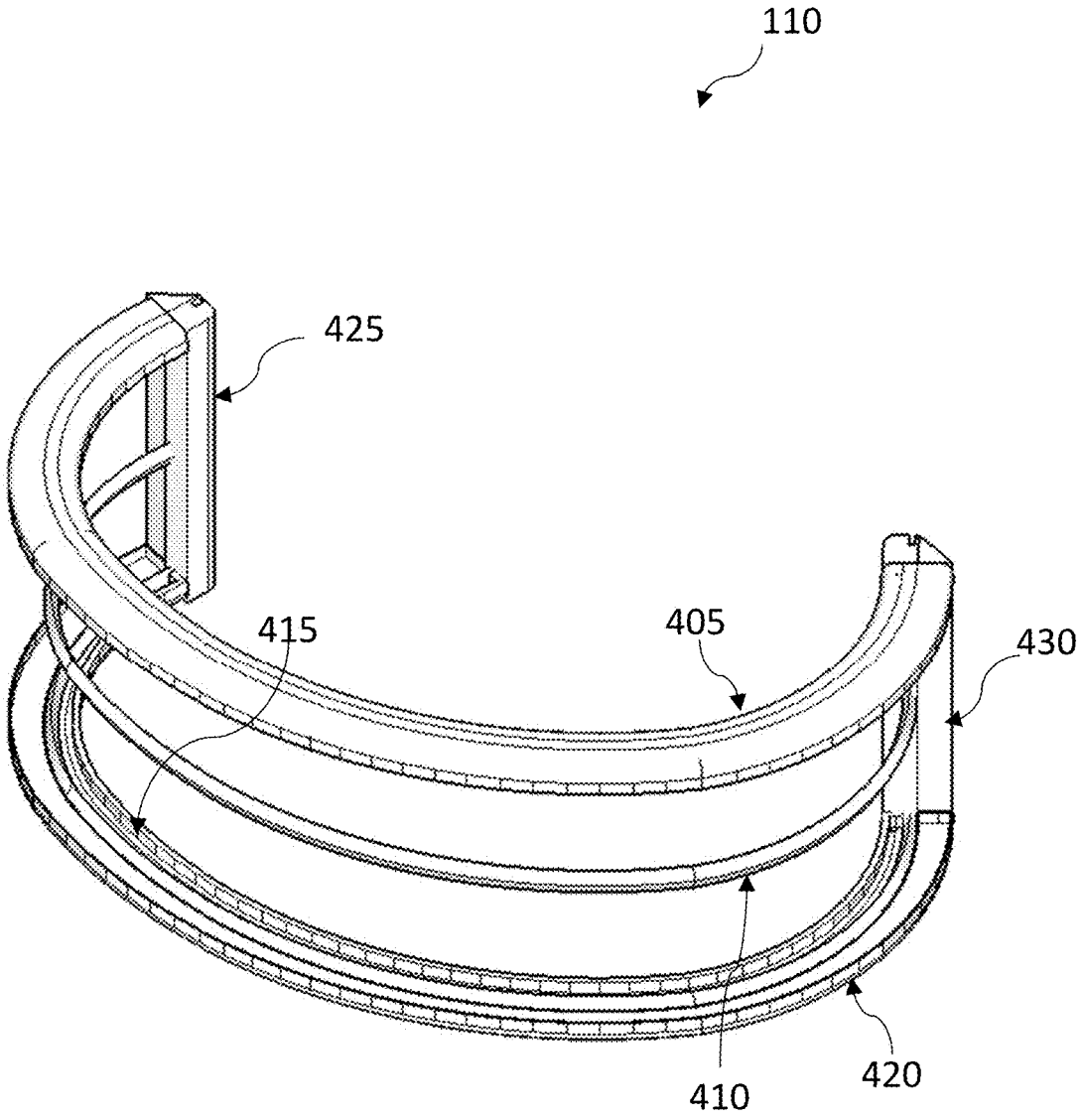
FIG. 4 shows the frame of the exercise machine, according to an exemplary embodiment of the present invention.

Disclosed is an exercise machine for loosening abdominal fat and at the same time also exercising the arms and shoulder. The exercise machine can be worn around the abdomen similar to an abdominal belt using fasteners, such as a hook and loop fastener. Referring to FIG. 1 which shows a perspective view of an exemplary embodiment of the exercise machine 100 and FIG. 2 which shows a side view of the exercise machine 100. FIG. 3 is a partially exploded view of the exercise machine 100 showing a frame 110, two sets of rollers 305 and 310, and a pair of handles 615 and 620. The disclosed exercise machine 100 can include a frame 110 more clearly shown in FIG. 4. The frame can be rigidly made from a durable and strong material, such as metal or plastic. Preferably, lightweight material can be used, such as Aluminum that is both durable and light in weight. The frame 110 can include an upper rail 405, a middle rail 410, and a lower rail 420 all running horizontally and parallel to each other and along the length of the frame 110. Frame 110 is curved in shape such as to conform to the shape of the abdomen. The upper rail and the lower rail can have channels on their inner surfaces. FIG. 4 shows a channel 415 in the inner surface of the lower rail 420. The three rails can be supported by two vertical columns, a first column 425 and a second column 430, at the ends of the three rails forming the frame 110. The two vertical columns can have a buckle for coupling two straps (not shown), wherein the straps can be tightened around the waist. The two straps can have a fastener at their ends, such as a hook and loop fasteners that can fasten the ends of two straps and also allows adjusting an overall length of the two straps.

Figure 5:
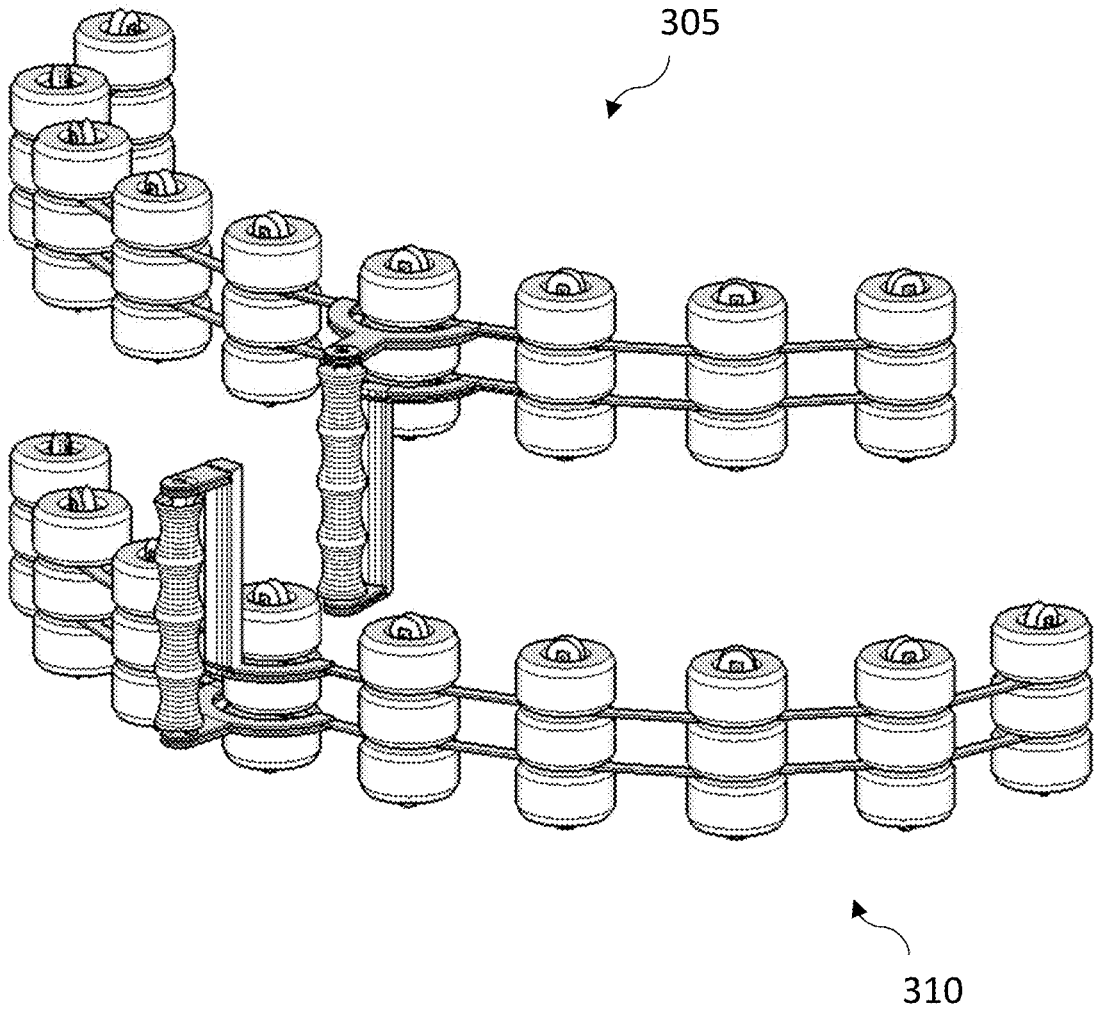
FIG. 5 shows the upper set of rollers and the lower set of rollers, according to an exemplary embodiment of the present invention.
Figure 6:
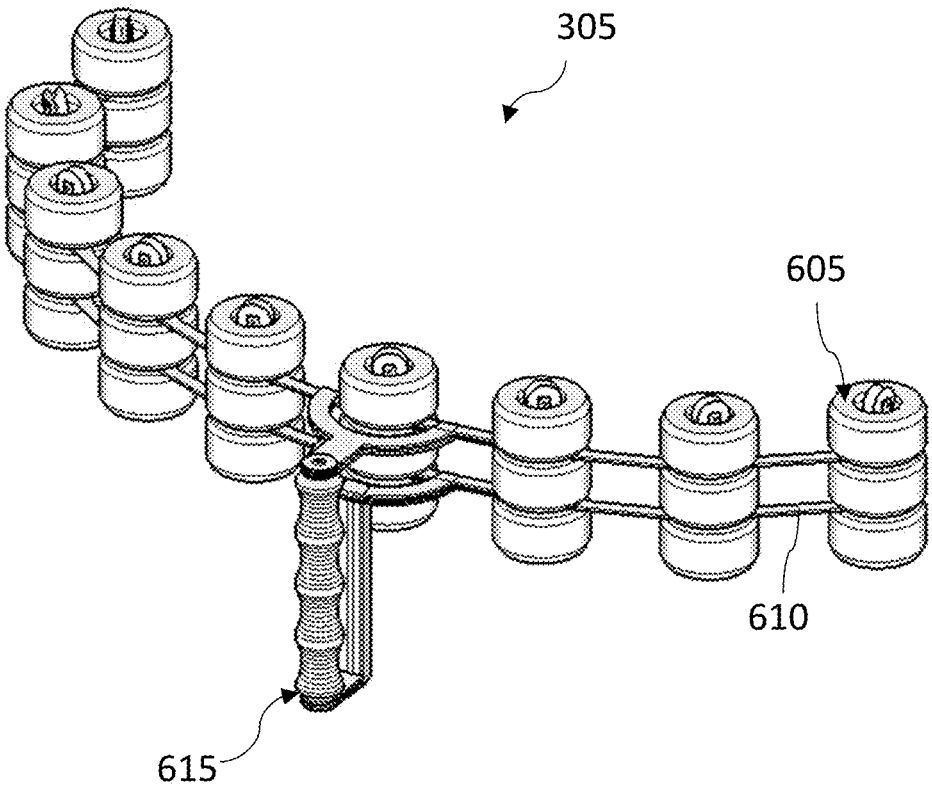
FIG. 6 shows the upper set of rollers separately for clarity, according to an exemplary embodiment of the present invention.
Figure 7:
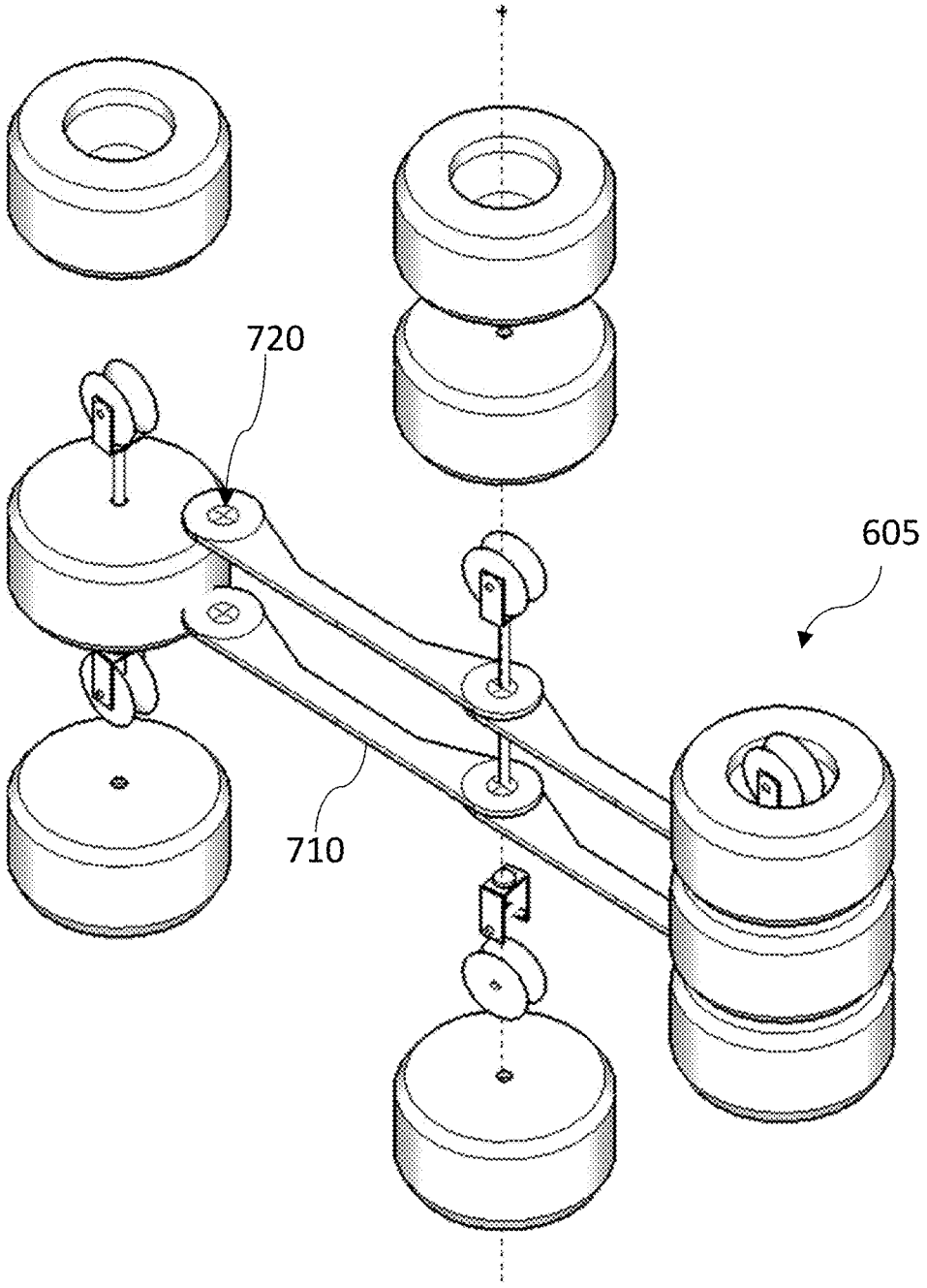
FIG. 7 is an exploded view of three rows of rollers connected by bridges, according to an exemplary embodiment of the present invention.
Figure 8:
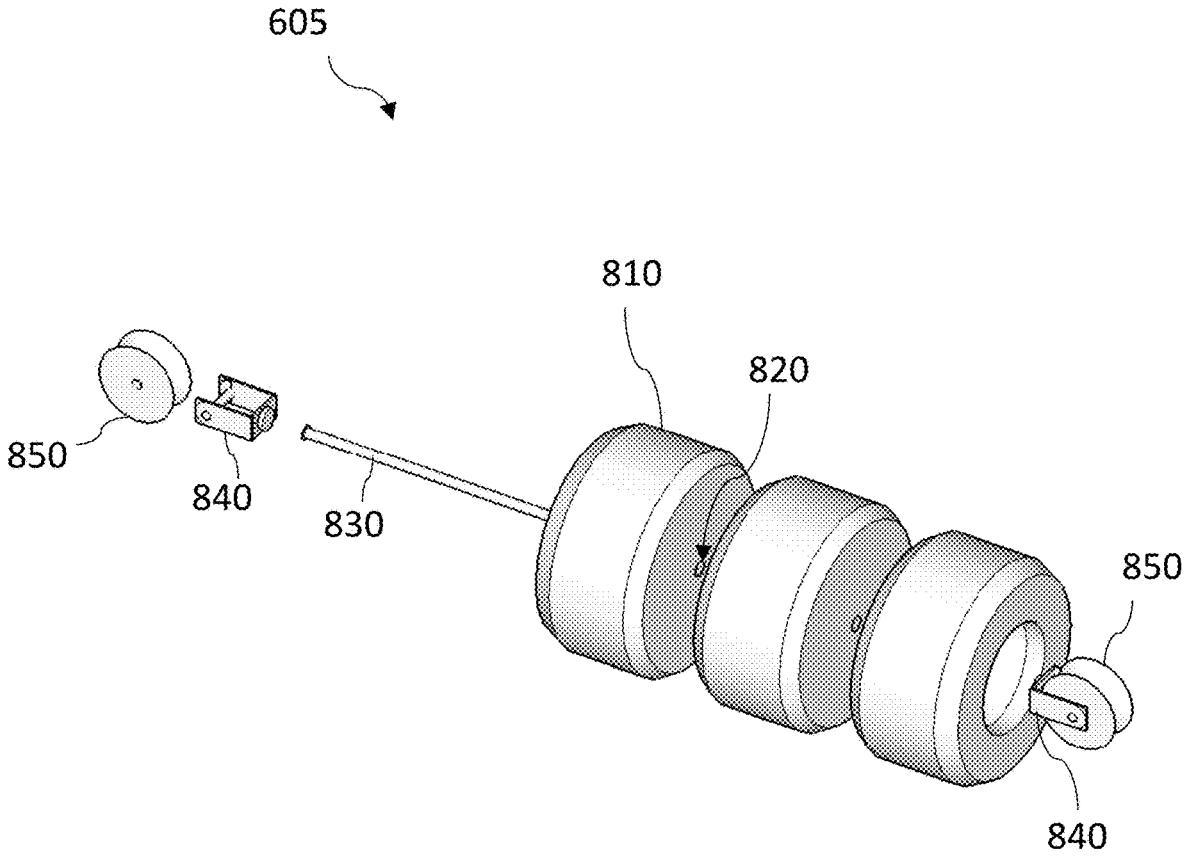
FIG. 8 is an exploded view of a single row of rollers showing the rollers, an axle, two blocks, and a wheel, according to an exemplary embodiment of the present invention.

The upper rail 405 and the middle rail 410 can form an upper track and the middle rail and the lower rail can form a lower track. To the upper track can be mounted vertically several rollers connected through a carrier. The rollers mounted in the carrier are referred to herein as a set of rollers. FIG. 3 shows two sets of rollers, an upper set of rollers 305 and a lower set of rollers 310. The upper set of rollers can be mounted in the upper track and the lower set of rollers can be mounted in the lower track of the frame. The upper set of rollers 305 and the lower set of rollers 310 can be more clearly seen in FIG. 5. FIG. 6 shows only the upper set of rollers 305 for clarity. Each set of rollers can include several rows of rollers 605 connected through bridges 610. Each row of rollers can include two or more rollers or beads that can roll relative to the bridge. FIG. 7 and FIG. 8 show an exploded view of the row of rollers. FIG. 7 shows three adjacent rows of rollers and bridges connecting the three rows of rollers. FIG. 8 is an exploded view of a single row of rollers 605.

Referring to FIG. 8 which is an exploded view of the row of rollers that includes three rollers 810 and each roller includes a tunnel 820 at its center. The rollers shown in FIG. 8 are cylindrical with a tunnel extending through the center of the cylindrical roller. The rollers can be made of metallic materials, such as steel and aluminum. The metallic rollers can be cooled and heated wherein the heated or cooled rollers can be rolled against the skin. In case of inner cover, the rollers can be rubbed against the inner rubber or silicone cover that can transfer the pressure to the skin. The rollers can also be made from any other material, such as plastic, ceramic, or glass. The size of rollers can also be varied for optimum abdominal fat disintegration. Moreover, the shape of rollers can be varied, for example, the rollers can be in the form of a dice with the tunnel extending through opposite vertices of the dice shape roller. The roller can also be spherical in shape or any other shape that is within the scope of the present invention. The term "roller" is also referred to herein as the "beads".

FIG. 8 shows three rollers in a single row, however, two or more rollers in a row are within the scope of the present invention. An axle 830 which is an elongated rod can pass through tunnel 820 of the rollers 810 holding the three rollers in the row. The rollers 810 can freely revolve relative to the axle 830. At opposite ends of the axle can be blocks 840 and two wheels 850 mounted to the two blocks 840. The wheels 850 can run in the channel of the rails of the frame. The bridges and axles form the carrier for the rollers.

Referring to FIG. 7, the adjacent rows of rollers 605 are connected through bridges 710. Each bridge can be an elongated narrow plate that can be slightly curved and includes two apertures at the ends of the narrow plate. The axle 830 can be inserted into the aperture 720. FIG. 7 shows two bridges connecting two rows of rollers, wherein ends of two adjacent bridges can overlap and the axle can pass through overlapping apertures of two bridges. It is to be understood that at least two bridges can be used to connect two adjacent rows of rollers for stability and durability, however one or more bridges connecting the two adjacent rows of rollers are within the scope of the present invention. The rows of rollers connected through the bridges can be mounted vertically in the upper track and the lower track, wherein the wheels can run in the channels in the rails of the upper track and the lower track. Several rollers mounted to the carrier forms a set of rollers that can slide back-and-forth in the upper track as a single unit. Similarly, another set of rollers can slide back-and-forth in the lower track.

Referring to FIG. 6 which shows a handle 615 coupled to the upper set of rollers 305. Each the upper set of rollers and the lower set of rollers can have a handle that can be grasped to move the set of rollers within the respective track in which the set of rollers is mounted. FIG. 3 shows two handles, the upper handle 615 and the lower handle 620. FIG. 5 shows the upper handle coupled to the upper set of rollers and the lower handle coupled to the lower set of rollers. It is to be understood that the handles including position of handles can be varied to make grasping the handles comfortable and increase the effectiveness of exercise.

Figure 9:
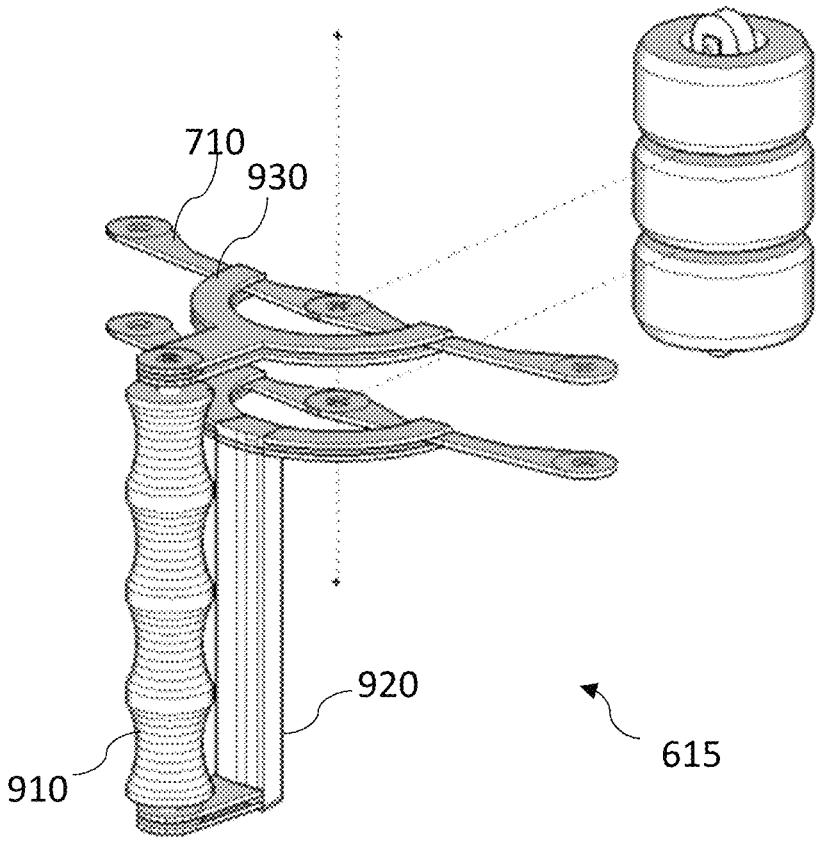
FIG. 9 shows the upper handle, according to an exemplary embodiment of the present invention.
Figure 10:
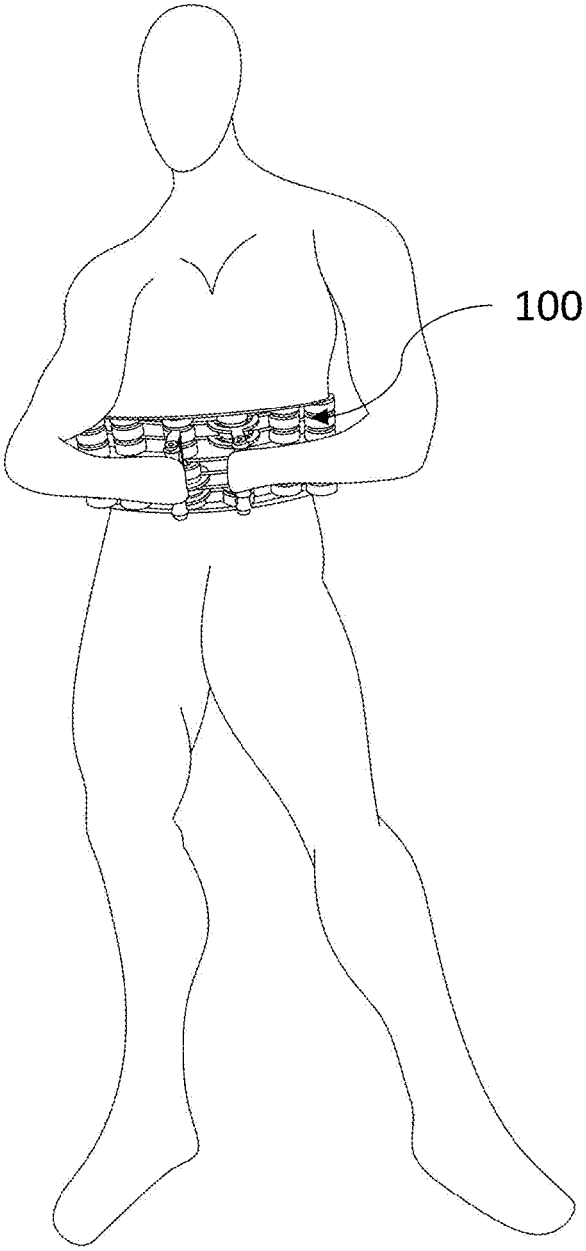
FIG. 10 shows a user wearing the disclosed exercise machine and grasping the upper handle and the lower handle, according to an exemplary embodiment of the present invention.

Referring to FIG. 9 which shows the upper handle 615 separated for clarity. The upper handle 615 can include a handlebar 910 that can be grasped by the hand. The upper handlebar also includes a first clamp 920 coupled to one end of the handlebar and a second clamp 930 coupled to the opposite end of the handlebar. Each the first clamp and the second clamp can couple to two adjacent bridges 710 as shown in FIG. 6.

Figure 11:
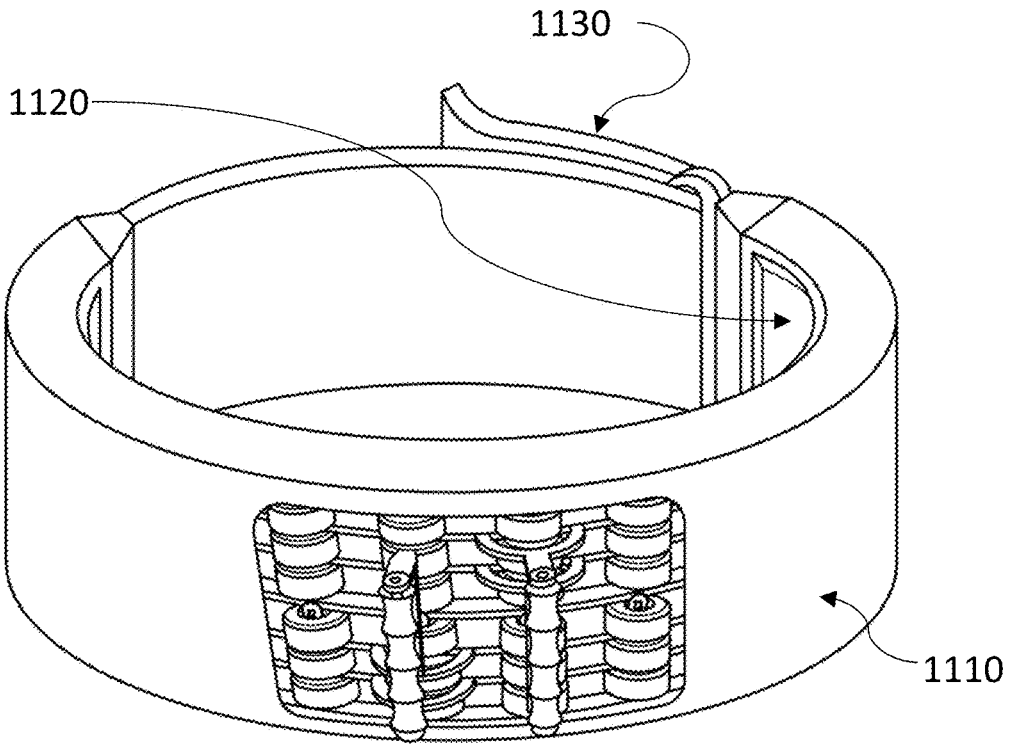
FIG. 11 shows the exercising machine with an inner cover and an outer cover, according to an exemplary embodiment of the present invention.

Referring to FIG. 11, the frame can be provided with an inner cover 1120 that expands over an area of the frame and forms a barrier between the skin and the rollers. This may prevent direct contact of the rollers with the skin during exercising. The inner cover 1120 can be made from a rubbery material that can prevent pinching of the skin and also saves the rollers from slipping due to sweat. Creams and other liquid formulations that can be applied to the skin to hasten the fat breakdown may also do not come in direct contact with the rollers due to the inner cover. The inner cover can be removed and washed, thus helps to maintain hygiene and comfort. Additionally, the inner cover can prevent any bruising of the skin due to the direct rubbing of the skin by the rollers. The material of the inner cover can be made of rubber or silicone that forms a water-tight pocket between the inner cover and the skin, and thus any liquid or cream applied to the skin cannot escape outside the boundary of the inner cover. Moreover, the space between the inner cover and the skin can be filled with cooling spray or nitrogen or warm materials to hasten fat disintegration. Thus, the inner cover can be preferably applied to the inner side of the frame for aforesaid advantages and applications.

Optionally, an outer cover 1110 can also be provided on the outer side of the frame and covering the rollers. Like the inner cover, the outer cover can also be removed and replaced. The outer cover can prevent any ingress of objects in between the rollers. For example, clothes or hairs may get tangled between the rollers, wherein the provision of the outer cover can safeguard against ingress of hair and clothes. Both the inner cover and the outer covers can be flexible. Also, it can be seen in FIG. 11 is a strap 1130 attached to the ends of the frame through buckles, the strap 1130 can be used to tighten the exercising machine around the abdomen.

In an exemplary embodiment, the disclosed exercise machine can have the rollers arranged as a left unit and a right unit respectively. A right handle can operate both the right upper and lower rollers and a left handle can operate both the left upper and lower rollers. Such an arrangement of the rollers can allow the disclosed exercise machine to fold for storage and transportation.

In certain embodiments, the exercise machine can include a battery or solar operated battery that avoids the need of manually pushing the handles inward and outward. Also, the rollers can also move in vertical or circular motion.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. An exercise machine for reducing abdominal fat and exercising arms and shoulders, the exercise machine comprising:

a frame comprising an upper rail, a middle rail, and a lower rail running horizontally and parallel to each other along a length of the frame, the upper rail and the middle rail forms an upper track, and the middle rail and the lower rail form a lower track;

an upper set of rollers mounted to the upper track, the upper set of rollers configured to roll back-and-forth in the upper track;

an upper handle coupled to the upper set of rollers;

a lower set of rollers mounted to the lower track, the lower set of rollers configured to roll back-and-forth in the lower track; and a lower handle coupled to the lower set of rollers, wherein the upper set of rollers and the lower set of rollers are configured such as when the exercise machine is worn around an abdomen of a user, the user is capable of grasping the upper handle and the lower handle to move back-and-forth the upper set of rollers and the lower set of rollers respectively, wherein rollers in the upper set of rollers and the lower set of rollers are configured to push against the abdomen.

2. The exercise machine according to claim 1, wherein the exercise machine further comprises an inner cover over an inner side of the frame covering the rollers in the upper set of rollers and the lower set of rollers.

3. The exercise machine according to claim 2, wherein the inner cover is made from rubber or silicone, and wherein the inner cover is configured to form an airtight pocket between the inner cover and skin when the exercise machine is worn over the abdomen.

4. The exercise machine according to claim 2, wherein the exercise machine further comprises an outer cover mounted to an outer side of the frame covering the rollers in the upper set of rollers and the lower set of rollers.

5. The exercise machine according to claim 1, wherein each of the upper set of rollers and the lower set of rollers comprises a plurality of rows of rollers connected through bridges, each row of rollers of the plurality of rows of rollers comprises two or more rollers, each roller of the two or more rollers has a tunnel passing through a center of the roller, an axle pass through the tunnel of the two or more rollers of the each row of rollers, the axle has wheels on opposite ends thereof, wherein the wheels run in respective channels in the upper rail, the middle rail, and the lower rail.

6. The exercise machine according to claim 5, wherein each bridge of the bridges is an elongated narrow plate having apertures at opposite ends, wherein the respective axle is inserted through the apertures of the bridges.

7. The exercise machine according to claim 1, wherein the exercise machine further comprises a left strap and a right strap, first ends of the left strap and the right strap are coupled to opposite ends of the frame, and second ends of the left strap and the right strap have fasteners for coupling the left strap to the right strap.

8. The exercise machine according to claim 7, wherein the fasteners are a hook and loop fastener.

9. The exercise machine according to claim 1, wherein each of the upper set of rollers and the lower set of rollers comprises a carrier to which the respective rollers are rotatably mounted.

10. The exercise machine according to claim 1, wherein the rollers in the upper set of rollers and the lower set of rollers are made from a material that is configured to be heated and cooled.

11. The exercise machine according to claim 1, wherein the rollers in the upper set of rollers and the lower set of rollers are cylindrical, each roller of the rollers in the upper set of rollers and the lower set of rollers has a tunnel passing through a center thereof.

12. A method for exercising arms and shoulders, and reducing abdominal fat, the method comprising the steps of:

providing an exercise machine comprising:

a frame comprising an upper rail, a middle rail, and a lower rail running horizontally and parallel to each other along a length of the frame, the upper rail and the middle rail forms an upper track, and the middle rail and the lower rail form a lower track, an upper set of rollers mounted to the upper track, the upper set of rollers configured to roll back-and-forth in the upper track, an upper handle coupled to the upper set of rollers, a lower set of rollers mounted to the lower track, the lower set of rollers configured to roll back-and-forth in the lower track; and a lower handle coupled to the lower set of rollers, wherein the upper set of rollers and the lower set of rollers are configured such as when the exercise machine is worn around an abdomen of a user, the user is capable of grasping the upper handle and the lower handle to move the upper set of rollers and the lower set of rollers back-and-forth, wherein rollers in the upper set of rollers and the lower set of rollers are configured to push against the abdomen;

wearing the exercise machine around the abdomen;

grasping the upper handle and the lower handle; and forcing the upper handle to move back-and-forth the upper set of rollers in the upper track and forcing the lower handle to move back-and-forth the lower set of rollers in the lower track.

13. The method according to claim 12, wherein the exercise machine further comprises an inner cover mounted to an inner side of the frame covering the rollers in the upper set of rollers and the lower set of rollers.

14. The method according to claim 13, wherein the inner cover is configured to form an airtight pocket between the inner cover and skin of the abdomen, wherein the method further comprises the step of filling a liquid in the airtight pocket.

15. The method according to claim 13, wherein the inner cover is configured to form an airtight pocket between the inner cover and skin of the abdomen, wherein the method further comprises the step of filling liquid nitrogen in the airtight pocket.

16. The method according to claim 13, wherein the inner cover is made of rubber or silicone.

17. The method according to claim 12, wherein the exercise machine further comprises an outer cover configured to mount over an outer side of the frame.

* * * * *